US009638155B2

(12) United States Patent
Kato et al.

(10) Patent No.: US 9,638,155 B2
(45) Date of Patent: May 2, 2017

(54) CONTROL DEVICE OF VEHICLE AND CONTROL METHOD OF VEHICLE

(71) Applicants: Hirokazu Kato, Nisshin (JP); Junpei Kakehi, Toyota (JP)

(72) Inventors: Hirokazu Kato, Nisshin (JP); Junpei Kakehi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 95 days.

(21) Appl. No.: 14/422,638

(22) PCT Filed: Nov. 18, 2013

(86) PCT No.: PCT/IB2013/002858
§ 371 (c)(1),
(2) Date: Feb. 19, 2015

(87) PCT Pub. No.: WO2014/080280
PCT Pub. Date: May 30, 2014

(65) Prior Publication Data

US 2015/0219058 A1 Aug. 6, 2015

(30) Foreign Application Priority Data

Nov. 21, 2012 (JP) ..... 2012-255025

(51) Int. Cl.
*F02N 11/08* (2006.01)
*F02N 15/06* (2006.01)

(52) U.S. Cl.
CPC ..... *F02N 11/0855* (2013.01); *F02N 11/0814* (2013.01); *F02N 11/0851* (2013.01);
(Continued)

(58) Field of Classification Search
CPC .. F02D 41/065; F02D 2250/06; F02D 41/062; Y02T 10/48; F02N 11/0814; F02N 11/0855; F02N 11/00; Y10T 477/68
(Continued)

(56) References Cited

U.S. PATENT DOCUMENTS 4,192,279 A * 3/1980 Maisch ..... F02D 17/04 123/179.1
8,442,717 B2 * 5/2013 Kanemoto ..... F02N 11/0825 123/179.25
(Continued)

FOREIGN PATENT DOCUMENTS

CN 102777304 A 11/2012
EP 2 161 442 A2 3/2010
(Continued)

*Primary Examiner* — Hung Q Nguyen
*Assistant Examiner* — John Bailey
(74) *Attorney, Agent, or Firm* — Oliff PLC

(57) ABSTRACT

A control device of a vehicle includes: a first gear connected to a crankshaft of an engine; a second gear capable of engaging the first gear; an actuator configure to move the second gear up to a position where the second gear engages the first gear; a motor configured to cause the second gear to rotate; and a controller configured to, when the engine is cranked by driving of the motor in response to elapsing of a predefined period after the actuator is actuated in response to a startup request signal of the engine, adjust a length of the predefined period on the basis of an operating state of a driver and a state of the vehicle at the time of reception of the startup request signal.

6 Claims, 5 Drawing Sheets

(52) U.S. Cl.
CPC ..... *F02D 2200/606* (2013.01); *F02N 11/087* (2013.01); *F02N 15/067* (2013.01); *F02N 2200/022* (2013.01); *F02N 2200/0801* (2013.01); *F02N 2200/101* (2013.01); *F02N 2300/2002* (2013.01); *F02N 2300/2011* (2013.01)

(58) Field of Classification Search
USPC ..... 123/179.4, 339.22; 701/112, 113; 477/111
See application file for complete search history.

(56) References Cited

U.S. PATENT DOCUMENTS

2002/0017260 A1 2/2002 Saito et al.
2010/0059007 A1 3/2010 Senda et al.
2010/0174465 A1* 7/2010 Gibson ..... B60W 10/02 701/70
2010/0282200 A1* 11/2010 Notani ..... F02N 11/0844 123/179.3
2011/0054765 A1* 3/2011 Lewis ..... F02D 41/062 701/112
2011/0056450 A1 3/2011 Notani
2011/0172901 A1* 7/2011 Okumoto ..... F02N 11/0818 701/113
2011/0174255 A1* 7/2011 Neuburger ..... B60L 3/0046 123/179.4
2011/0246050 A1* 10/2011 Roessle ..... F02N 11/0855 701/113
2012/0029797 A1 2/2012 Notani
2012/0186551 A1* 7/2012 Rentschler ..... F02N 11/0855 123/179.3
2012/0260878 A1* 10/2012 Kitano ..... F02N 11/0855 123/179.3
2012/0271537 A1* 10/2012 Okabe ..... F02D 11/10 701/112
2012/0290194 A1 11/2012 Shoda et al.
2013/0090798 A1* 4/2013 Fukushiro ..... B60K 6/445 701/22
2013/0118431 A1 5/2013 Moriya et al.
2013/0133605 A1* 5/2013 Neet ..... F02N 11/08 123/179.3
2013/0180490 A1* 7/2013 Odahara ..... F02N 15/00 123/179.4
2013/0289855 A1* 10/2013 Kitano ..... F02N 11/00 701/113
2014/0066255 A1* 3/2014 Yu ..... F02N 11/0822 477/203

FOREIGN PATENT DOCUMENTS

JP 2002-122059 A 4/2002
JP 2005-330813 A 12/2005
JP 2010-084754 A 4/2010
JP 2010-285983 A 12/2010
JP 2012-237218 A 12/2012
WO 2012/008048 A1 1/2012

* cited by examiner

CONTROL DEVICE OF VEHICLE AND CONTROL METHOD OF VEHICLE

BACKGROUND OF THE INVENTION

1. Field of the Invention

The invention relates to a control device of a vehicle and to a control method of a vehicle. More particularly, the invention relates to a control device of a vehicle equipped with an engine startup starter that is capable of controlling individually an actuator for moving a pinion gear up to a position at which the pinion gear engages a ring gear that is connected to a crankshaft of an engine, and a motor for causing the pinion gear to rotate, and relates also to a control method of the vehicle.

2. Description of Related Art

With a view to reducing fuel consumption and exhaust emissions, automobiles having an internal combustion engine or the like as a engine are in some instances equipped with, for example, an idling stop system (start-stop system) that automatically stops the engine in a state where the vehicle is stopped and the driver has operated the brake pedal, and that triggers automatic restart according to a renewed drive-off operation by the driver where, for example, the operation amount of the brake pedal drops to zero.

Conventional starters include starters used for starting an engine and capable of individually driving an engagement mechanism (actuator) for displacing a pinion gear of the starter to a position at which the pinion gear engages a ring gear of the engine, and a motor for causing the pinion gear to rotate. Further, upon engine startup, a scheme in which the engine is cranked by the motor after engagement of the pinion gear and the ring gear is employed in some instances.

WO 2012/008048 discloses features relating to a vehicle in which an engine is started through the use of a starter that is capable of controlling individually an actuator and a motor such as those described above. Specifically, WO 2012/008048 discloses a control scheme wherein the period that elapses until the motor is driven, after determination of engine startup, is set to be substantially constant, both in an instance where rotation of the pinion gear precedes engagement of the latter, and an instance where engagement of the pinion gear precedes rotation of the latter.

In the configuration disclosed in WO 2012/008048, the motor is driven after a predefined time established beforehand has elapsed since initiation of the actuator operation, in a case where the pinion gear is rotated by the motor after the pinion gear engages with the ring gear by the actuator. The durability of the gears may be impaired, due to shock upon meshing, when the motor is driven in a state of unreliable meshing between the pinion gear and the ring gear. In order to mitigate shock at the time of meshing, therefore, the abovementioned predefined time is ordinarily set to a sufficient time that enables reliable meshing between the pinion gear and the ring gear.

In some instances, however, the engine must be started quickly, for instance upon drive-off when a traffic light at an intersection changes over to green immediately after an engine stop command had been outputted as the vehicle came to a stop at a red light. In a case where quick engine startup is required, it is thus desirable to shorten the time that elapses from the start of the actuator operation until start of the motor operation. Herein, WO 2012/008048 does not give due consideration to such a case, and a constant time is set throughout. The demands of the user may in some instances fail to be met.

SUMMARY OF THE INVENTION

The invention provides a control device of a vehicle, and a control method of a vehicle, that allow adjusting, as needed, the startup timing of an engine, in consideration of user demands or the state of the vehicle.

A first aspect of the invention relates to a control device of a vehicle. The control device has a first gear, a second gear, an actuator, a motor and a controller. The first gear is connected to a crankshaft of the engine. The second gear can engage the first gear. The actuator moves the second gear up to a position where the second gear engages the first gear. The motor causes the second gear to rotate. The controller actuates the actuator in response to a startup request signal of the engine. When the engine is cranked by driving of the motor in response to elapsing of a predefined period after the actuator is actuated, the controller adjusts a length of the predefined period on the basis of an operating state of a driver and a state of the vehicle at the time of reception of the startup request signal.

The controller may set the predefined period to a first period in a case where the startup request signal is received in a state where a rotational speed of the engine is higher than a reference speed, and may set the predefined period to a second period shorter than the first period in a case where the startup request signal is received in a state where the rotational speed is lower than the reference speed.

The controller may set the first period to be longer as the rotational speed becomes higher.

The controller may set the predefined period to be shorter in a case where the startup request signal is received in a state where an accelerator is being operated by the driver than in a case where the startup request signal is received in a state where the accelerator is not being operated by the driver.

The controller may set the predefined period to be shorter in a case where the startup request signal is received in a state where a vehicle speed is higher than a predefined value than in a case where the startup request signal is received in a state where the vehicle speed is lower than the predefined value.

The vehicle may be capable of traveling through switching between a first mode and a second mode in which travel performance is given more emphasis than in the first mode. In that case, the controller may set the predefined period to be shorter in a case where the second mode is set than in a case where the first mode is set.

A second aspect of the invention relates to a control method of a vehicle. The control method includes: i) actuating an actuator that moves a second gear that can engage a first gear connected to a crankshaft of an engine, up to a position where the second gear engages the first gear, in response to a startup request signal of the engine; ii) driving a motor that causes the second gear to rotate, in response to elapsing of a predefined period after the actuator is actuated; and iii) adjusting, upon cranking of the engine, a length of the predefined period on the basis of an operating state of a driver and a state of the vehicle at the time of reception of the startup request signal.

By virtue of the above features, it becomes possible to adjust, as needed, the startup timing of an engine, in a vehicle equipped with an idling stop system (start-stop system), in consideration of user demands or the state of the vehicle. As a result, it becomes possible to perform an engine startup operation that meets the demands of the user.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
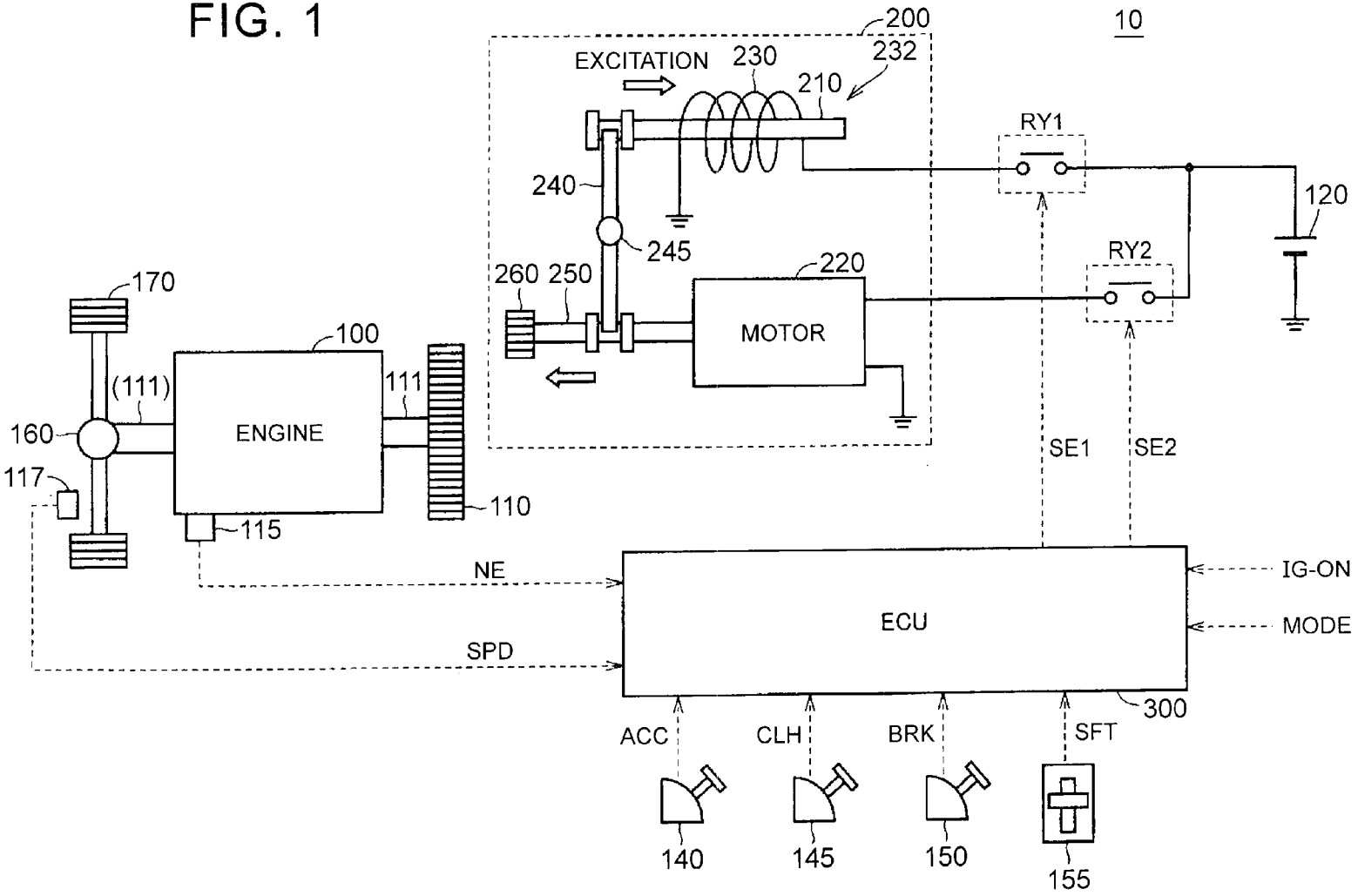
FIG. 1 is an overall block diagram of a vehicle equipped with a control device according to Embodiment 1.

Embodiments of the invention are explained next with reference to drawings. In the explanation, identical components are denoted by identical reference numerals. The denominations and functions of these components are likewise identical. Accordingly, a detailed explanation thereof will not be repeated.

FIG. 1 is an overall block diagram of a vehicle 10 equipped with a control device according to Embodiment 1. With reference to FIG. 1, the vehicle 10 is provided with an engine 100, a battery 120, a starter 200, a control device (hereafter also referred to as ECU 300), and relays RY1, RY2. The starter 200 has a plunger 210, a motor 220, a solenoid 230, a connection portion 240, an output member 250 and a pinion gear 260.

The engine 100 generates a driving force for enabling the vehicle 10 to travel. A crankshaft 111 of the engine 100 is connected to drive wheels 170 by way of a power transmission device 160 that is made up of a clutch, a reducer and so forth.

A rotational speed sensor 115 is provided in the engine 100. The rotational speed sensor 115 detects a rotational speed NE of the engine 100, and outputs the detection result to the ECU 300. A vehicle speed sensor 117 for vehicle speed detection is provided in the vicinity of the drive wheels 170. The vehicle speed sensor 117 detects vehicle speed on the basis of the rotation of the drive wheels 170, and outputs a corresponding detection value SPD to the ECU 300. The position at which the vehicle speed sensor 117 is disposed is not limited to the vicinity of the drive wheels 170, and the vehicle speed sensor 117 may be provided in the vicinity of a driven wheel (not shown). The vehicle speed sensor 117 may be omitted in a case where the vehicle speed is detected indirectly on the basis of, for instance, the rotational speed or reduction ratio of the engine 100.

The battery 120 is an electric power storage element configured to be chargeable and dischargeable. The battery 120 is made up of a secondary battery such as a lithium ion battery, a nickel hydride battery, or a lead storage battery. The battery 120 may be configured out of an electric storage element such as an electric double-layer capacitor.

The battery 120 is connected to the starter 200 by way of the relay RY1 and/or relay RY2 that are controlled by the ECU 300. Through closing of the relay RY1 and/or relay RY2, the battery 120 supplies power source voltage for driving to the starter 200. The negative electrode of the battery 120 is connected to a body earth of the vehicle 10.

One end of the relay RY1 is connected to the positive electrode of the battery 120. The other end of the relay RY1 is connected to one end of a solenoid 230 in the starter 200. The relay RY1, which is controlled according to a control signal SE1 by the ECU 300, switches between supply and cutoff of power source voltage from the battery 120 to the solenoid 230.

One end of the relay RY2 is connected to the positive electrode of the battery 120. The other end of the relay RY2 is connected to the motor 220 of the starter 200. The relay RY2, which is controlled according to a control signal SE2 by the ECU 300, switches between supply and cutoff of power source voltage from the battery 120 to the motor 220.

As described above, supply of power source voltage to the solenoid 230 and the motor 220 of the starter 200 can be controlled independently by way of the relay RY1 and the relay RY2, respectively.

The output member 250 is connected to a rotating shaft of a rotor (not shown) of the motor by way of, for instance, a straight spline or the like. The pinion gear 260 is provided at an end of the output member 250, on a side opposite that of the motor 220. Through closing of the relay RY2, power source voltage is supplied from the battery 120 to the motor 220, and the latter rotates as a result. Thereupon, the output member 250 transmits the rotation of the rotor to the pinion gear 260, and the pinion gear 260 rotates thereby.

One end of the solenoid 230 is connected to the relay RY1. The other end of the solenoid 230 is connected to the body earth. Upon excitation of the solenoid 230 through closing of the relay RY1, the solenoid 230 causes the plunger 210 to move in the direction of the arrow. That is, the solenoid 230 and the plunger 210 make up an actuator 232.

The plunger 210 is connected to the output member 250 by way of the connection portion 240. The connection portion 240 has a fixed fulcrum 245. As a result, the output member 250 moves in the opposite direction to the operation direction of the plunger 210. When the solenoid 230 is excited, the plunger 210 moves in the direction of the arrow. As a result, the output member 250 is caused to move from a standby position, illustrated in FIG. 1, to an engagement position of the pinion gear 260 and the ring gear 110. The plunger 210 has a spring mechanism, not shown, such that the plunger 210 is urged by a force in a direction opposite to that of the arrow in FIG. 1. As a result, the plunger 210 returns to the standby position when the solenoid 230 is no longer excited.

Through excitation of the solenoid 230, thus, the output member 250 moves in the axial direction towards the ring gear 110. As a result, the pinion gear 260 engages the ring gear 110 that is attached to the crankshaft 111 of the engine 100. The pinion gear 260 rotates, through the action of the motor 220, in a state where the pinion gear 260 and the ring gear 110 are engaged. The engine 100 is cranked and started as a result. The ring gear 110 is provided, for instance, at the outer periphery of the flywheel of the engine.

In the present embodiment, thus, the actuator 232 that moves the pinion gear 260 and the motor 220 that rotates the pinion gear 260 are controlled individually in such a manner that the pinion gear 260 engages the ring gear 110 of the engine 100.

Although not shown in FIG. 1, a one-way clutch may be provided between the output member 250 and the rotor shaft of the motor 220. The one-way clutch prevents rotation of the rotor of the motor 220 derived from the rotation of the ring gear 110.

The actuator 232 of FIG. 1 is not limited to a mechanism such as the one described above, and need only be a mechanism that allows transmitting the rotation of the pinion gear 260 to the ring gear 110, and that allows switching between a state in which the pinion gear 260 and the ring gear 110 are engaged, and a state in which the foregoing are not engaged. For instance, the actuator 232 may be a mechanism such that the pinion gear 260 and the ring gear 110 become engaged through displacement of the shaft of the output member 250 in the radial direction of the pinion gear 260.

Although not shown in any of the figures, the ECU 300 has a central processing unit (CPU), a storage device, and an input-output buffer. The ECU 300 receives the input of sensor values from respective sensors, and outputs control commands to various devices. Control by the ECU 300 is not limited to software processing, and processing may be partially accomplished by relying on built-in dedicated hardware (electronic circuitry).

The ECU 300 receives a signal ACC that denotes the operation amount of an accelerator pedal 140 from a sensor (not shown) that is provided in the accelerator pedal 140. The ECU 300 receives a signal CLH that denotes the operating state of a clutch pedal 145 from a sensor (not shown) provided in the clutch pedal 145. The ECU 300 receives a signal BRK that denotes the operating state of a brake pedal 150 from a sensor (not shown) provided in the brake pedal 150.

The ECU 300 receives a startup operation signal IG-ON derived, for instance, from an ignition operation by the driver. The ECU 300 receives also, from a shift device 155, a signal SFT that denotes a shift position. The ECU 300 receives a signal MODE that denotes a travel mode. The travel mode includes, for instance, an economy mode where fuel economy is emphasized, and a sport mode in which travel performance is emphasized. The travel mode is set by the user, by way of a switch that is provided in a console, and/or by way of a setting screen such as a liquid crystal panel.

On the basis of these information items, the ECU 300 generates a startup request signal or stop request signal of the engine 100. In accordance therewith, the ECU 300 outputs the control signal SE1 and the control signal SE2, to control thereby the operation of the starter 200.

An outline of control of the starter at the time of engine startup from an engine stop state will be explained next with reference to the time chart of FIG. 2. The abscissa axis in FIG. 2 denotes time. The ordinate axes denote a startup signal STAT of the engine 100, the operating state of the actuator 232 (control signal SE1 of the relay RY1), the operating state of the motor 220 (control signal SE2 of the relay RY2), and the engine rotational speed NE.

Figure 2:
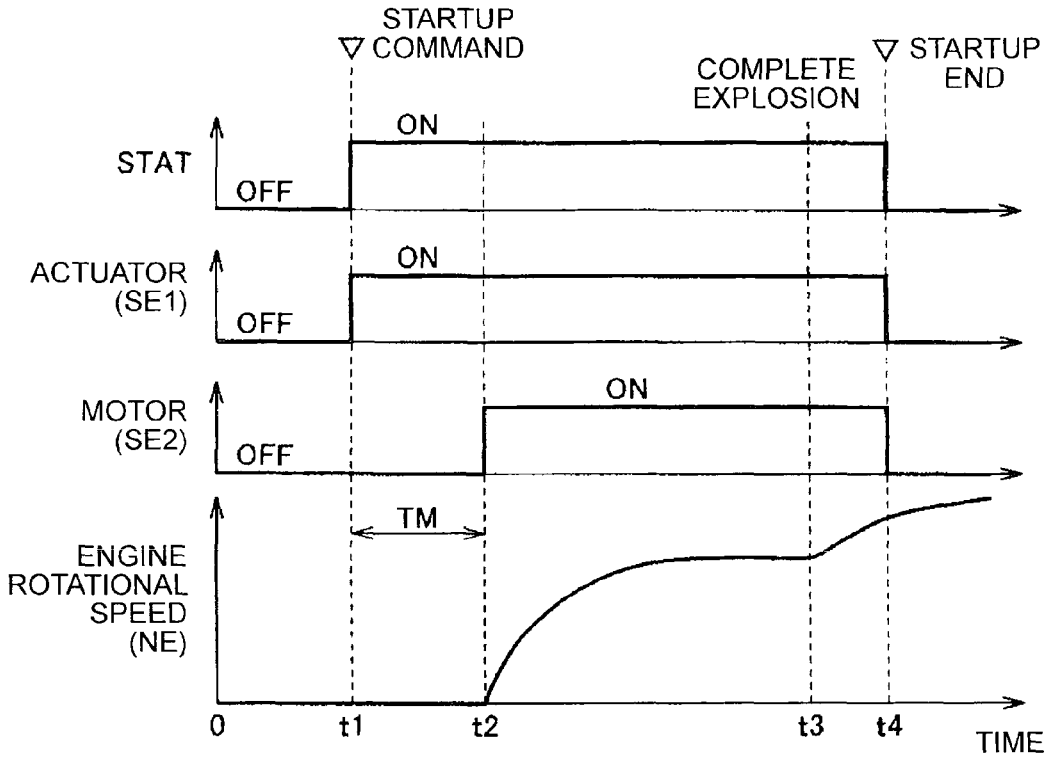
FIG. 2 is a time chart for explaining an operating state at the time of ordinary engine startup, in a case where the starter of FIG. 1 is used.

With reference to FIG. 1 and FIG. 2, the engine startup signal STAT is turned on, at time t1, for instance on the basis of an ignition operation by the user or on the basis of an engine restart signal at the time of engine stop. In response to engine startup signal STAT being turned on, the control signal SE1 of the relay RY1 is set to on, and the operation of the actuator 232 is initiated. As a result, the pinion gear 260 moves up to the engagement position with the ring gear 110.

When a predefined time TM has elapsed since the engine startup signal STAT has been turned on, as denoted by time t2 in FIG. 2, the control signal SE2 of the relay RY2 is set to on, and the rotation of the motor 220 is initiated. As a result, the engine 100 is cranked and the engine rotational speed NE increases.

The ignition operation is performed during cranking of the engine 100. At time t3 in FIG. 2, a self-sustained operation of the engine 100 begins upon complete explosion of the fuel in the cylinders of the engine 100. The engine rotational speed NE further increases as a result.

Thereafter, the engine startup signal STAT is turned off in response to the beginning of the self-sustained operation of the engine 100. The control signal SE1 and the control signal SE2 are then turned off. Actuating of the actuator 232 and the motor 220 ends as a result at time t4 in FIG. 2.

Ordinarily, the predefined time TM until start of the motor 220 in FIG. 2 is set to a sufficient time for the pinion gear 260 to engage the ring gear 110. The purpose of this is to suppress rotation of the pinion gear 260 in a state where the pinion gear 260 and the ring gear 110 are not sufficiently engaged. Impact forces arise at the tooth surfaces of the gears when the pinion gear 260 rotates in a state where the latter and the ring gear 110 are not sufficiently engaged. These forces may impair the durability of the gears.

In some instances, the engine rotational speed NE is equal to or higher than a predefined speed at which the pinion gear 260 and the ring gear 110 can engage, when the engine startup signal STAT is turned on, for instance if the engine 100 must be restarted immediately after a stop request of the engine 100 in a state where engine stop is being executed. Accordingly, the above predefined time TM must be set taking into account the time required for the engine rotational speed NE to drop to a predefined speed at which the pinion gear 260 and the ring gear 110 can engage. Accordingly, the predefined time TM is set in some instances on the basis of a maximum required time that it takes the engine rotational speed NE to drop in order for the pinion gear 260 and the ring gear 110 to engage.

When using the predefined time TM set in the above manner, a state is continued in which the motor 220 is not started, despite the fact that engagement between the pinion gear 260 and the ring gear 110 is already sufficiently complete, if the engine is started from the engine stop state, for instance as illustrated in FIG. 2. That is, the time elapsed from an engine startup request until engine start completion is prolonged unnecessarily.

An explanation follows next on startup control in which, accordingly, the length of the predefined time TM is modified on the basis of whether or not there is an engine startup request during a drop of the engine rotational speed NE in Embodiment 1. More specifically, the predefined time TM is set to be shorter in a case where there is an engine startup request in a state where the engine rotational speed NE is lower than a predefined reference speed Nth, than in a case where there is an engine startup request in a state where the engine rotational speed NE is higher than the predefined reference speed Nth. This allows shortening unnecessary wait time until motor driving, and hence the drive-off performance of the vehicle can be enhanced without incurring loss of gear durability.

Figure 3:
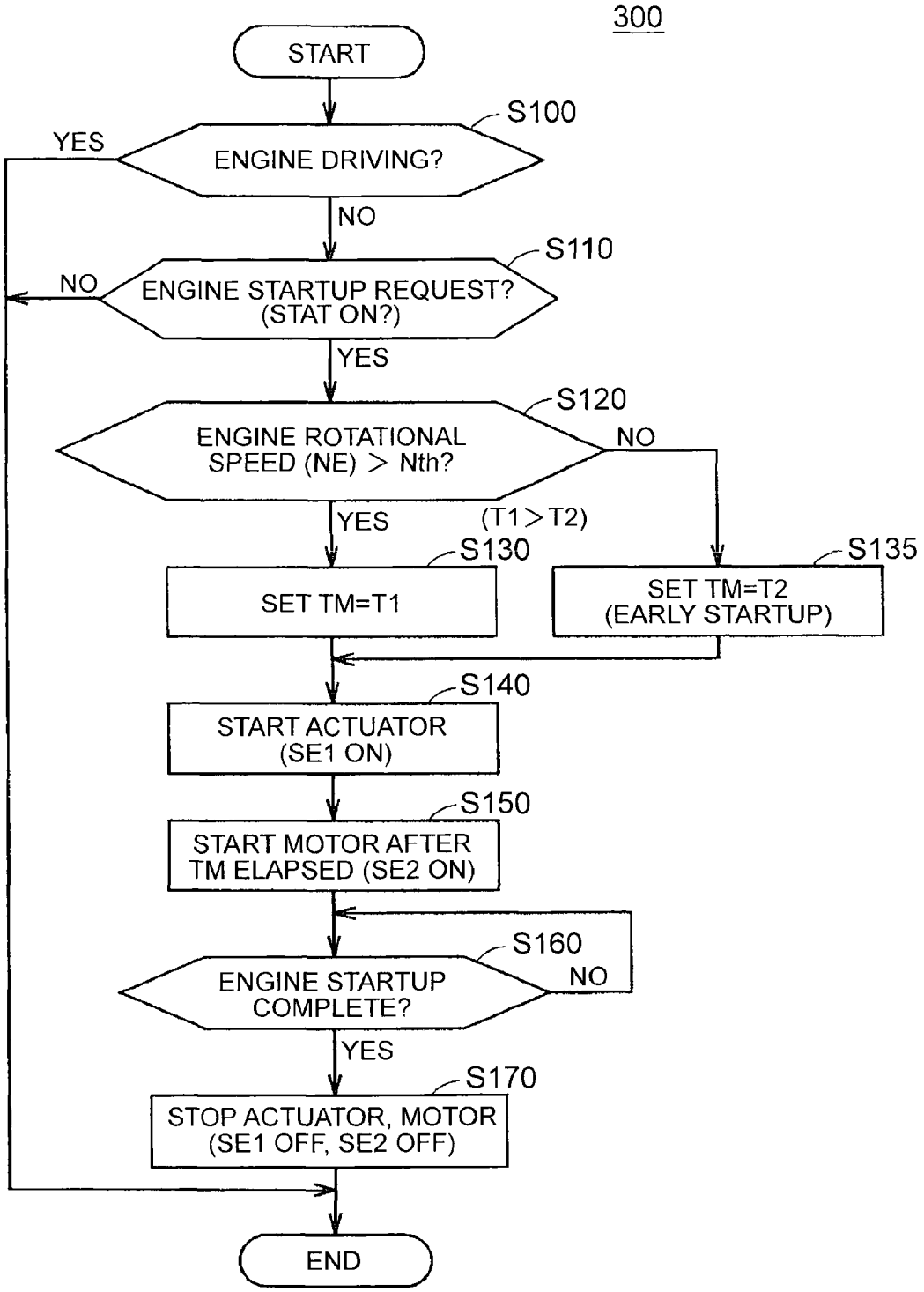
FIG. 3 is a flowchart for explaining the details of a startup control process of an engine, as executed by an electronic control unit (ECU), in Embodiment 1.

FIG. 3 is a flowchart for explaining the details of a startup control process of the engine, as executed by the ECU 300, in Embodiment 1. The flowcharts illustrated in FIG. 3 and in FIG. 4 and FIG. 5 described below are implemented through execution, at predefined periods, of a program that is stored beforehand in the ECU 300. Alternatively, some of the steps of the process can be implemented by relying on built-in dedicated hardware (electronic circuitry).

With reference to FIG. 1 and FIG. 3, the ECU 300 determines in step S100 whether the engine 100 is currently generating drive or not.

If the engine 100 is generating drive (YES in S100), the subsequent startup process is not required. The process thereafter is accordingly skipped, and the ECU 300 terminates the process.

If the engine 100 is not generating drive (NO in S100), the process moves on to S110. In S110, the ECU 300 determines whether there is an engine startup request or not, i.e. whether the start signal STAT is on or not.

If there is no engine startup request (NO in S110), the engine 100 need not be started, and hence the ECU 300 skips the subsequent process, and terminates the process.

If there is an engine startup request (YES in S110), the process moves on to S120. In S120, the ECU 300 determines next whether the engine rotational speed NE is higher than the predefined reference speed Nth.

If the engine rotational speed NE is higher than the reference speed Nth (YES in S120), the process moves on to S130. In S130, the ECU 300 sets, as the predefined time TM, a time T1 into which there is factored the time for a drop of the engine rotational speed NE, and moves the process on to S140.

If the engine rotational speed NE is equal to or smaller than the reference speed Nth (NO in S120), the process moves on to S135. In S135, the ECU 300 sets, as the predefined time TM, a time T2 that is shorter than time T1 above, and moves the process on to S140.

In S140, the ECU 300 turns the control signal SE1 on, to close thereby the relay RY1, and moves the process on to S150. The actuator 232 is actuated as a result, and the pinion gear 260 and the ring gear 110 engage each other.

Once the predefined time TM set in S130 or S135 has elapsed, the ECU 300, in response thereto, turns the control signal SE2 on in S150, to close thereby the relay RY2, and moves the process on to S160. As a result, the motor 220 is started, and the engine 100 is cranked. Although not explicitly indicated in FIG. 2, the ECU 300 triggers fuel injection and an ignition operation by an ignition device, in conjunction with starting of the motor 220.

Thereafter, the ECU 300 determines, in S160, whether or not startup of the engine 100 is complete in that a self-sustained operation of the engine 100 is established. Startup of the engine 100 can be determined to be complete or not, for instance, by determining whether or not the engine rotational speed NE has risen up to a speed that denotes self-sustained operation.

If startup of the engine 100 is not complete (NO in S160), the process returns to S160, and the ECU 300 continues the cranking operation and the ignition operation.

If startup of the engine 100 is complete (YES in S160), the process moves on to S170. In S170, the ECU 300 turns off the control signal SE1 and the control signal SE2, to shut off thereby the actuator 232 and the motor 220. The ECU 300 terminates thereby the startup operation.

The set values T1, T2 of the predefined time TM may be constant values established beforehand, or may be set to be variable in accordance with the engine rotational speed NE and/or other conditions. In particular, the set value T1 may be set to an larger value as the rotational speed of the engine becomes higher, than at a time where the rotational speed of the engine is low.

Performing control according to a process such as the above-described one allows setting the time up to motor driving to be variable, in accordance with the engine rotational speed at the time of engine startup request. As a result, this allows suppressing unnecessary delays in the motor start timing. The drive-off performance of the vehicle can be accordingly enhanced.

In Embodiment 1, an instance has been explained wherein the time until motor driving is modified depending on whether or not there is an engine startup request during a drop of the engine rotational speed NE.

In some instances, early startup of the engine may be desired by the user, without regard to the state of the engine at the time of startup request. Such instances include, for example, an instance where the engine startup operation is performed while the accelerator pedal is being depressed, an instance where the brake pedal is released in a state where the engine is stopped by an idling stop system (start-stop system), or an instance where the shift position is switched from a neutral range (N range) to a travel range, or the clutch pedal is operated. The above features apply also to an instance where the travel mode is set to the sport mode, in which travel performance is emphasized.

In such a case, the needs of the user may be met by prescribing the cranking timing of the engine to be as early a timing as possible.

An explanation follows next on drive-off control in Embodiment 2 that involves modifying the predefined time TM until motor driving, on the basis of whether or not there is an early drive-off operation by the user in the case of an engine startup request.

Figure 4:
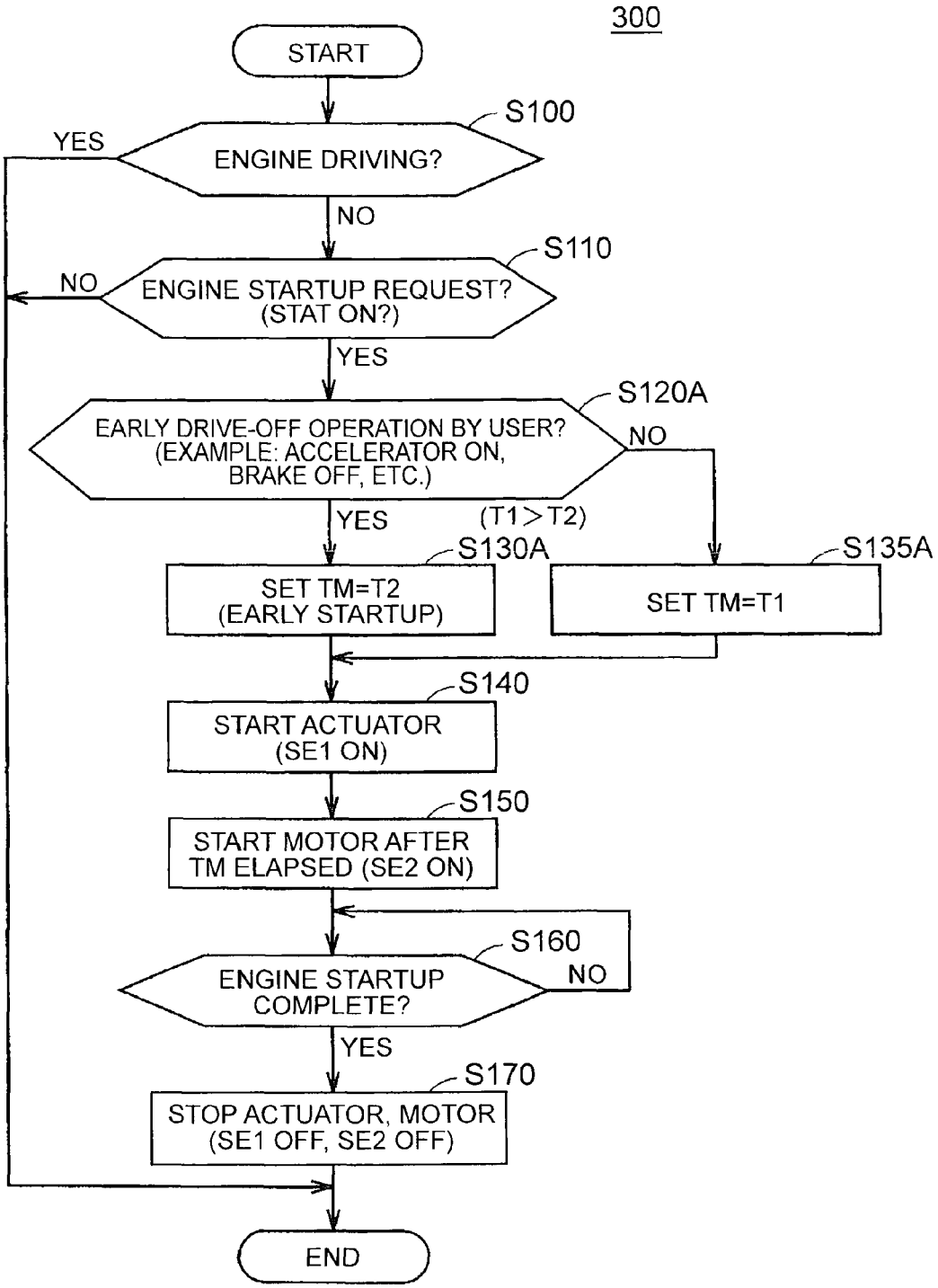
FIG. 4 is a flowchart for explaining the details of a startup control process of an engine, as executed by an ECU, in Embodiment 2.

FIG. 4 is a flowchart for explaining the details of a startup control process of the engine, as executed by the ECU 300, in Embodiment 2. In FIG. 4, steps S120, S130, and S135 of the flowchart in FIG. 3 of Embodiment 1 are now replaced by step S120A, S130A and S135A. The steps in FIG. 4 that overlap with those of FIG. 3 will not explained again herein.

With reference to FIG. 1 and FIG. 4, if in a state where the engine 100 is not driven (NO in S100) there is an engine startup request (YES in S110), the process moves on to S120A. In S120A, the ECU 300 determines whether there is an early drive-off operation by the user or not.

In case of no early drive-off operation (NO in S120A), the process moves on to S135A. In S135A, the ECU 300 sets the predefined time TM to a time T1 that is normally used, and the process moves on to S140.

In case of early drive-off operation (YES in S120A), the process moves on to S130A. In S130A, the ECU 300 sets the predefined time TM to a time T2 that is shorter than the time T1, and the process moves on to S140.

Thereafter, in S140, the ECU 300 starts the actuator 232 and, after elapsing of the predefined time TM set in S130A or S135A, the ECU 300 starts in S150 the motor 220, whereby the engine 100 is cranked. The process thereafter is identical to that of Embodiment 1.

The times T2, T1 that are respectively used in S130A and S135A above may be values identical to or different from those used in Embodiment 1, and may be set to be fixed values or to be variable in accordance with other conditions.

By performing control in accordance with a process such as the above-described one, the engine startup timing is brought to an earlier timing in a case where early drive-off is desired by the user, and hence the demands of the user can be satisfied.

Depending on the configuration of the idling stop system (start-stop system), stopping of the engine may in some instances be executed not only in a state where the vehicle is in complete stop, but also during deceleration while the vehicle is traveling. In a state where the engine is stopped during vehicle deceleration, an engine restart request may in some instances be issued before the vehicle stops, or engine restart may not occur until the rotational speed of the engine has dropped to or below a predefined rotational speed, upon stoppage of the vehicle.

However, the needs of the user can be met, in that the engine is restarted without waiting for the vehicle to come to a stop, in a case where an engine restart request is issued during vehicle deceleration, i.e. in a case where early engine startup is desired by the user.

An explanation follows next on an instance of engine startup control in Embodiment 3 wherein, accordingly, the predefined time TM until motor driving is modified in a case where an engine restart request is issued during vehicle deceleration.

Figure 5:
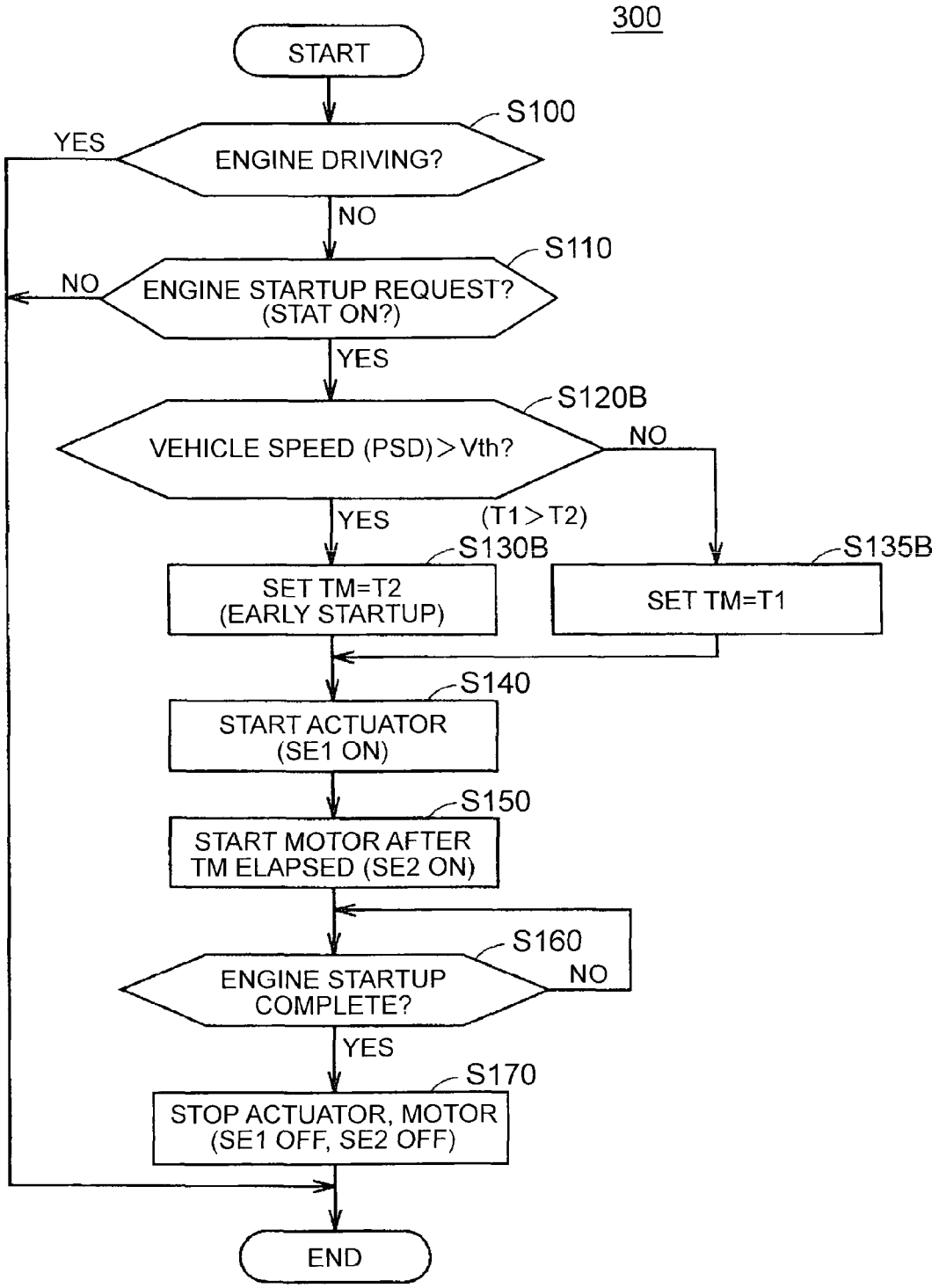
FIG. 5 is a flowchart for explaining the details of a startup control process of an engine, as executed by an ECU, in Embodiment 3.

FIG. 5 is a flowchart for explaining the details of a startup control process of the engine, as executed by the ECU 300, in Embodiment 3. In FIG. 5, steps S120, S130, and S135 of the flowchart in FIG. 3 of Embodiment 1 are now replaced by steps S120B, S130B and S135B. The steps in FIG. 5 that overlap with those of FIG. 3 will not explained again herein.

With reference to FIG. 1 and FIG. 5, if in a state where the engine 100 is not driven (NO in S100) there is an engine startup request (YES in S110), the process moves on to S120B. In S120B the ECU 300 determines whether or not a vehicle speed PSD is greater than a predefined threshold value Vth, i.e. whether or not the engine has been restarted before stoppage of the vehicle, in a state where the engine was stopped during deceleration.

If the vehicle speed PSD is equal to or smaller than the predefined threshold value Vth (NO in S120B), the process moves on to S135B. In S135B, the ECU 300 sets the predefined time TM to a time T1 that is normally used, and the process moves on to S140.

If the vehicle speed PSD is greater than the predefined threshold value Vth (YES in S120B), the process moves on to S130B. In S130B, the ECU 300 sets the predefined time TM to a time T2 that is shorter than the time T1, and the process moves on to S140.

Thereafter, the ECU 300 starts the actuator 232 in S140 and, after elapsing of the predefined time TM set in S130B or S135B, the ECU 300 starts in S150 the motor 220, whereby the engine 100 is cranked. The process thereafter is identical to that of Embodiment 1.

The times T2, T1 that are respectively used in S130B and S135B above may be values identical to or different from those used in Embodiment 1, and may be set to be fixed values or to be variable in accordance with other conditions.

By performing control in accordance with a process such as the above-described one, the engine startup timing is brought to an earlier timing in the case of an engine restart request in an engine stop state during vehicle deceleration. The demands, of the user can be satisfied thereby.

If Embodiment 2 or Embodiment 3 is resorted to, the motor 220 may in some instances rotate in a state where the pinion gear 260 and the ring gear 110 are not sufficiently engaged. Accordingly, some limitations may be imposed, for instance, on the setting of the predefined time and the number of times the control schemes are implemented, by taking into account, among other factors, the life of the gears and the driving style of the user.

Embodiments 1 and 3 above may be combined with each other in arbitrary ways. In such cases, the predefined time may be set, as appropriate, in accordance with the various conditions.

The embodiments disclosed herein are, in all features thereof, exemplary in nature, and are not meant to be limiting in any way. The scope of the invention, which is defined by the appended claims and not by the explanation above, is meant to encompass equivalents as well as all modifications of the claims.

What is claimed is:

1. A control device for a vehicle, the control device comprising:

a first gear connected to a crankshaft of an engine;

a second gear capable of engaging the first gear;

an actuator configured to move the second gear—up to a position—where at which the second gear engages the first gear;

a motor configured to cause the second gear to rotate;

and an electronic control unit programmed to: adjust a length of a time period between (i) actuation of the, actuator in response to a startup request signal of the engine and (ii) subsequent driving of the motor to crank the engine, based on a state based on a state of the vehicle at a time of reception of the startup request signal, wherein the electronic control unit sets the length of the time period to a first length when the startup request signal is received in a state where a rotational speed of the engine is higher than a reference speed, and the electronic control unit sets the length of the time period to a second length shorter than the first length when the startup request signal is received in a state where the rotational speed of the engine is lower than the reference speed.

2. The control device according to claim 1, wherein the electronic control unit is programmed to increase the first length as the rotational speed of the engine increases above the reference speed.

3. A control method for a vehicle having an electronic control unit, the control method being performed by the electronic control unit and comprising:

actuating an actuator that moves a second gear that is capable of engaging a first gear connected to a crankshaft of an engine of the vehicle, so that the second gear is moved to a position at which the second gear engages the first gear, in response to a startup request signal of the engine;

driving a motor that causes the second gear to rotate, in response to elapsing of a time period after the actuator has been actuated; and adjusting a length of the time period between (i) the actuating of the actuator in response to the startup request signal of the engine and (ii) the subsequent driving of the motor to cause the second gear to rotate and crank the engine, based on a state of the vehicle at a time of reception of the startup request signal, wherein the electronic control, unit sets the length of the time period to a first length when the startup request signal is received in a state where a rotational speed of the engine is higher than a reference speed; and, the electronic control unit sets the length of the time period to a second length shorter than the first length when the startup request signal is received in a state where the rotational speed of the engine is lower than the reference speed.

4. The control method according to claim 3, wherein the electronic control unit increases the first length as the rotational speed of the engine increases above the reference speed.

5. The control method according to claim 3, wherein the electronic control unit also adjusts the length of the time period based on an operating state of a driver of the vehicle.

6. The control device according to claim 1, wherein the electronic control unit also is programmed to adjust the length of the time period based on an operating state of a driver of the vehicle.

* * * * *